US005117256A

United States Patent [19]

Haibara

[11] Patent Number: 5,117,256

[45] Date of Patent: May 26, 1992

[54] COMPENSATION METHOD FOR VARIABLE MAGNIFICATION IN AN OPTICAL ZOOMING SYSTEM

[75] Inventor: Fumio Haibara, Akishima, Japan

[73] Assignee: Konica Corporation, Tokyo, Japan

[21] Appl. No.: 708,191

[22] Filed: May 31, 1991

[30] Foreign Application Priority Data

Jun. 5, 1990 [JP] Japan ..... 2-146623
Jun. 5, 1990 [JP] Japan ..... 2-146622

[51] Int. Cl.[5] ..... G03G 15/00

[52] U.S. Cl. ..... 355/77; 355/55; 355/243

[58] Field of Search ..... 355/208, 235, 243, 55, 355/56, 57, 66, 77

[56] References Cited

U.S. PATENT DOCUMENTS 4,571,064 2/1986 Hayashi et al. ..... 355/57
4,766,466 8/1988 Kawal ..... 355/57

FOREIGN PATENT DOCUMENTS 57-39057 4/1982 Japan .
61-56335 7/1986 Japan .

*Primary Examiner*—R. L. Moses

*Attorney, Agent, or Firm*—Finnegan, Henderson, Farabow, Garrett & Dunner

[57] ABSTRACT

In a method for compensating a variable image magnification in an optical zoom system, a magnified image is formed on a focal surface by projecting a document image through a projection lens and onto mirrors provided to an optical path length adjusting device. The position of the projection lens and the optical path length adjusting device are compensated so that an actual image magnification is the same as a selected nominal image magnification. An optional nominal magnification within a predetermined variable magnification range is selected. At least one of the projection lens and the variable optical path length adjusting device is moved so as to be in focus and then an actual image magnification at a position where the projection lens is in focus is measured. An actual focal length of the projection lens is calculated from the measured magnification according to equations with respect to magnification, focal length, principal points and so on. Each compensating position of the projection lens and the optical path length adjusting device in accordance with the selected magnification is determined, based on the calculated focal length and the optional nominal magnification.

5 Claims, 5 Drawing Sheets

COMPENSATION METHOD FOR VARIABLE MAGNIFICATION IN AN OPTICAL ZOOMING SYSTEM

BACKGROUND OF THE INVENTION

The present invention relates to the compensation of movement of a projection lens and a mirror optical path length adjusting means, necessary for improving the accuracy of an operation to make an actual magnification agree with a nominal magnification in an image-forming operation of a copier, in which there may be fluctuations in focal length, mirror tilting angle and flatness of the projection lens of the optical zooming system.

As illustrated in FIG. 4, in a scanning type of variable magnification optical zooming system, an image is formed on an image carrier in such a manner that: a light source 2 opposed to a platen glass 1, a plurality of mirrors 3, 4, 5, 6 and a projection lens 7 are utilized so that a document image 10 placed on the platen glass 1 can be formed on an image carrier, such as a photoreceptor drum 8. The aforementioned light source 2 and the first mirror 3 are combined into one unit so that a first moving carriage is formed, and the aforementioned second mirror 4 and the third mirror 5 are combined into one unit so that a second moving carriage is formed. The aforementioned two moving carriages move in the direction parallel with the aforementioned platen glass 1 so that the document image 10 can be scanned.

In order to change the image magnification in the aforementioned scanning type of variable magnification optical zooming system, the mirrors are moved so that the total optical path length from the aforementioned document image 10 to the aforementioned photoreceptor drum 8 can be changed by one of the following two systems: a front-path system in which the aforementioned projection lens 7 is moved in the direction of an arrow A corresponding to a predetermined magnification, and the aforementioned second moving carriage, which is composed of the second mirror 4 and the third mirror 5, is moved; and the other is a rear-path system in which the aforementioned projection lens 7 is moved in the same manner as described above, and the final mirror which is the aforementioned fourth mirror 6, is moved.

Relating to the above-described conventional technology, inventions have been disclosed in Japanese Patent Application Open to Public Inspection No. 56335/1986 and Japanese Utility Model No. 39057/1982. The former invention relates to an optical path length adjusting means in which the optical length is adjusted by the rear-path system during variation of magnification. The latter invention relates to an optical length adjusting means and its driving method in which the optical length is adjusted by the front-path system during variation of magnification.

However, the focal length of a projection lens used for a variable magnification optical zooming system is dispersed due to error caused in the manufacturing process so that an allowance of ±1% is usually provided with regard to the standard focal length. The tilting angle and flatness of the mirrors which are used for the optical length adjusting means, are also dispersed.

Consequently, in the case of a projection lens of a standard focal length, the actual magnification is different from the nominal magnification in the home position in which the magnification is life-size. When a zooming operation of an optional magnification is conducted by the same movement of the projection lens, the actual magnification necessarily differs from the nominal magnification.

In the variable magnification optical zooming system having the aforementioned projection lens and optical path length adjusting means, the actual in-focus position in a nominal life-size or an optional nominal magnification during variation of magnification is different from the in-focus position in a case in which a projection lens of standard focal length and an optical path length adjusting means having mirrors of correct setting are utilized. For example, in the case of a projection lens, the focal length of which is 200 mm, the error of the focal length is in the range of ±2 mm. The error of movement is calculated as follows: in the case of the magnification of 2, movement is about 100 mm±1 mm, wherein an in-focus position of the life-size is used as the starting position; and in the case of the reduction of 0.5, movement is about 200 mm±2 mm. Referring to the aforementioned calculated value, in the case of the enlargement, the magnification is 2, the actual image magnification is 1.99 to 2.01 when the error of movement is ±1 mm. In the case of a popular type of copier, the magnification of which is not more than 1.5, the error of magnification of about 1% causes no problem. However, in the case of a high magnification type of high grade copier by which a high resolution is required, users severely evaluate the quality of the obtained image not only in the case in which the magnification is life-size, but also in the case in which the magnification is the maximum value (for example, 2) or the reduction is the minimum value (for example, 0.5). Accordingly, an image having the aforementioned magnification error is not acceptable to users.

In the manner described above, the focal length of a projection lens deviates from the standard value, and further there are errors in the accuracy of the optical path length adjusting means. Therefore, the standard position of a projection lens of the standard focal length is different from the actual position of an actual projection lens, or the standard position of an optical path length adjusting means of the standard dimension is different from the actual position of an actual optical path length adjusting means. Accordingly, when the apparatus is adjusted according to the standard value, the obtained image is out of focus and the magnification becomes different from a predetermined value.

SUMMARY OF THE INVENTION

It is a primary object of the present invention to provide compensation method for variable magnification in an optical zooming system by which magnification is the same as a nominal value, and image-formation of high resolution can be obtained.

The present invention provides a compensation method for variable magnification, in an optical zooming system of a scanning type, in which an image of each magnification is formed by projecting a document image with a projection lens and an optical path length adjusting means, and in which the positions of the projection lens and the optical path length adjusting means are compensated so that the actual image magnification can be the same as the nominal set magnification, in such a manner that: in an optical path length to which at least one of the optional nominal set magnifications within a predetermined variable magnification range is set, the projection lens and/or the optical path length adjusting means are moved so as to be in focus and the actual image magnification is measured in the position where the projection lens is in focus; and the real focal length of the projection lens is computed from the measured magnification according to the following equations $$1/f=1/a+1/bm=b/a$$

$$U=(2+m+1/m)f+H+\delta m; \text{ and}$$

U, a and b are computed from the real focal length and nominal magnification by the above-described equations in order to determine the compensating positions of the projection lens and the optical path length adjusting means, where f: focal length of the projection lens
m: magnification
a: distance from the document image to the first principal point of the projection lens
b: distance from the second principal point of the projection lens to the focal surface
H: distance between the principal points of the projection lens
δm: aberration of the projection lens
U: total optical path length from the document surface to the focal surface.

According to another method of the present invention which is a scanning type of variable magnification in an zooming system in which a document image is projected by a projection lens and a plurality of mirrors so that an image of a nominal magnification can be formed, the in-focus position which is suited to two optional nominal set magnifications of a predetermined variable magnification range, can be obtained as follows. The aforementioned projection lens and the optical path length adjusting means composed of some of the aforementioned mirrors are moved from the standard position so as to be in focus. Then, the difference between the position of the projection lens of the standard focal length and its standard position, and the difference between the position of the optical path length adjusting means and its standard position, are found according to the following equations.

According to the results obtained by the computation, the positions of the projection lens and the optical path length adjusting means are compensated so that the actual image magnification can become the same as the nominal set magnification in each variation of magnification, and so that the image can be perfectly in focus.

$$1/f=1/a+1/bm=b/a$$

$$U=(2+m+1/m)f+H+\delta m$$

where f: focal length of the projection lens
m: magnification
a: distance from the document image to the first principal point of the projection lens
b: distance from the second principal point of the projection lens to the focal surface
H: distance between the principal points of the projection lens
δm: aberration of the projection lens
U: total optical path length from the document surface to the focal surface.

DESCRIPTION OF THE PREFERRED EMBODIMENTS

Figure 1A:
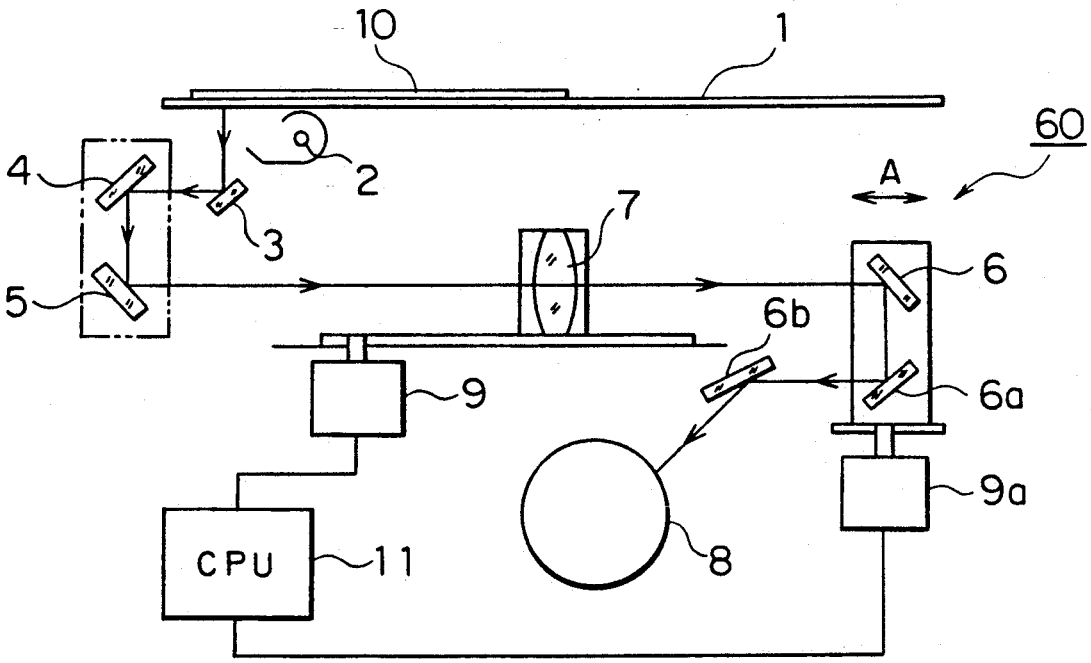
FIG. 1(*a*)–1(*e*) are schematic illustrations showing variable magnification optical zooming systems of each embodiment according to the present invention.
Figure 1B:
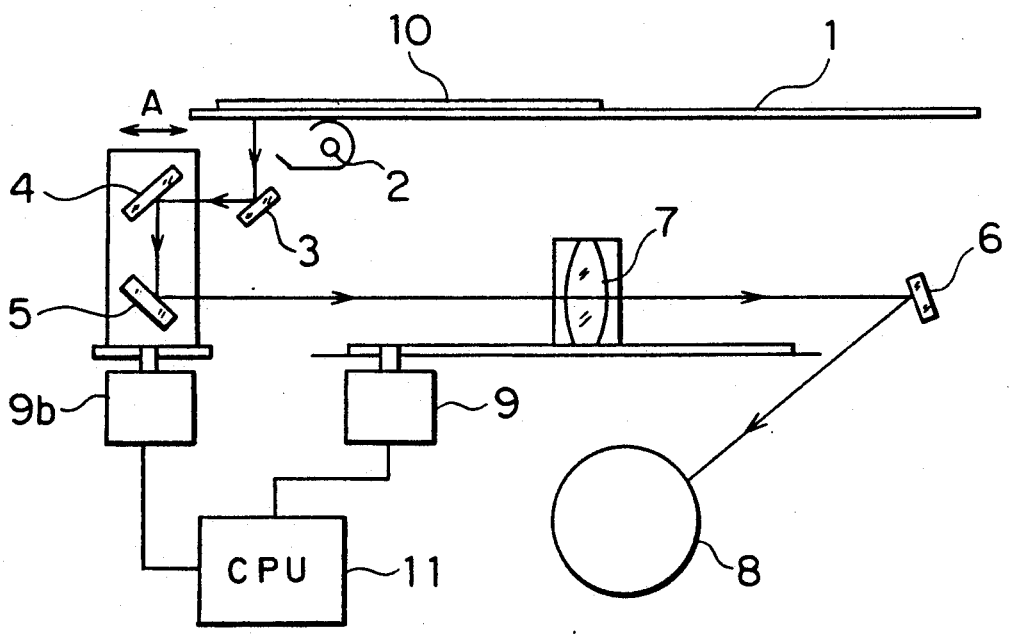
Figure 1C:
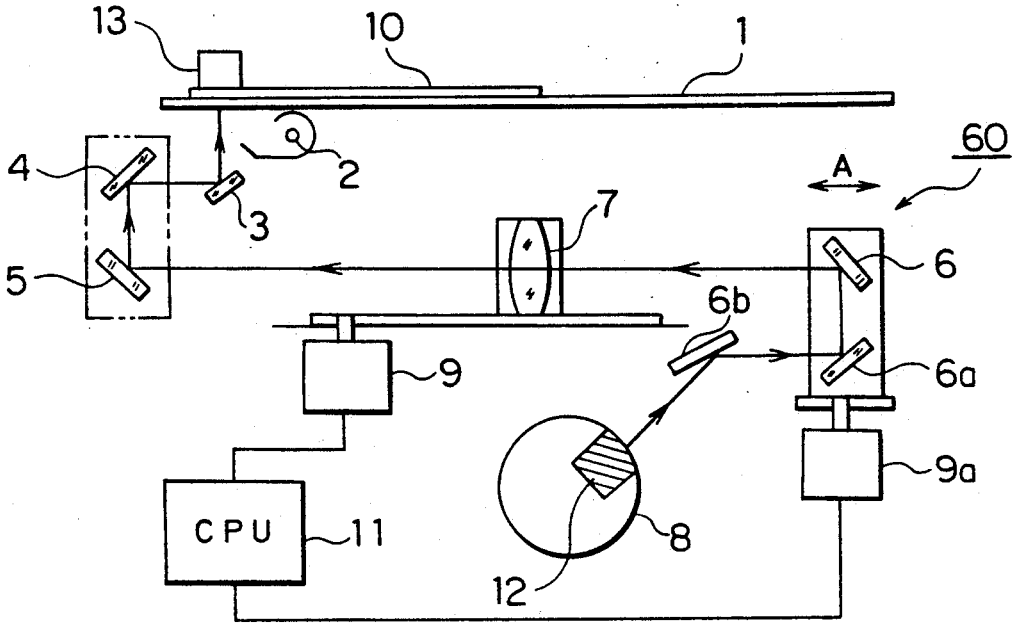
Figure 1D:
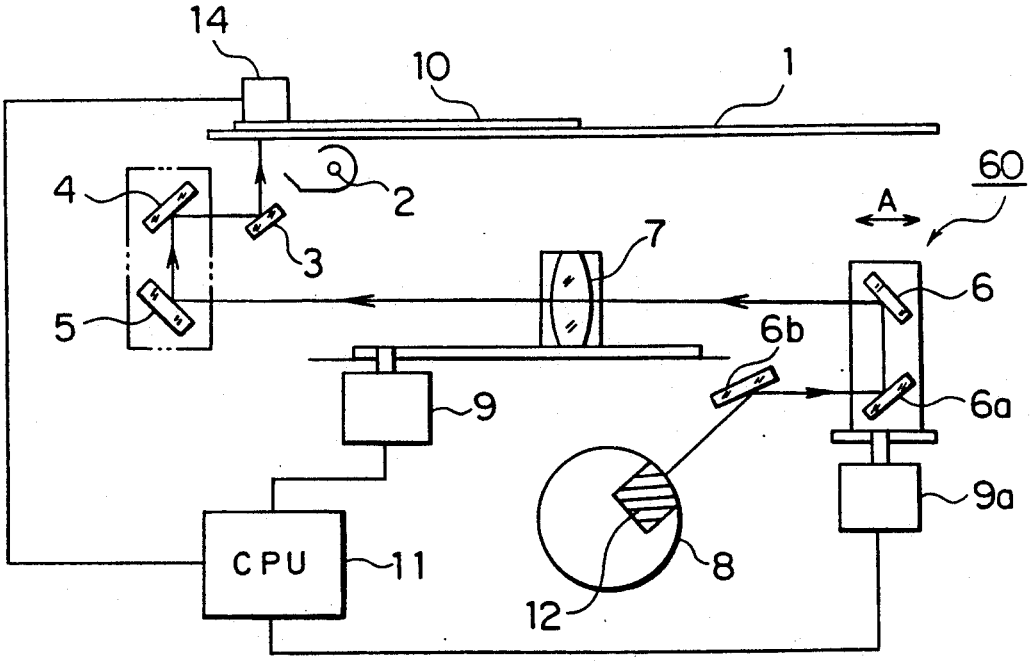
Figure 1E:
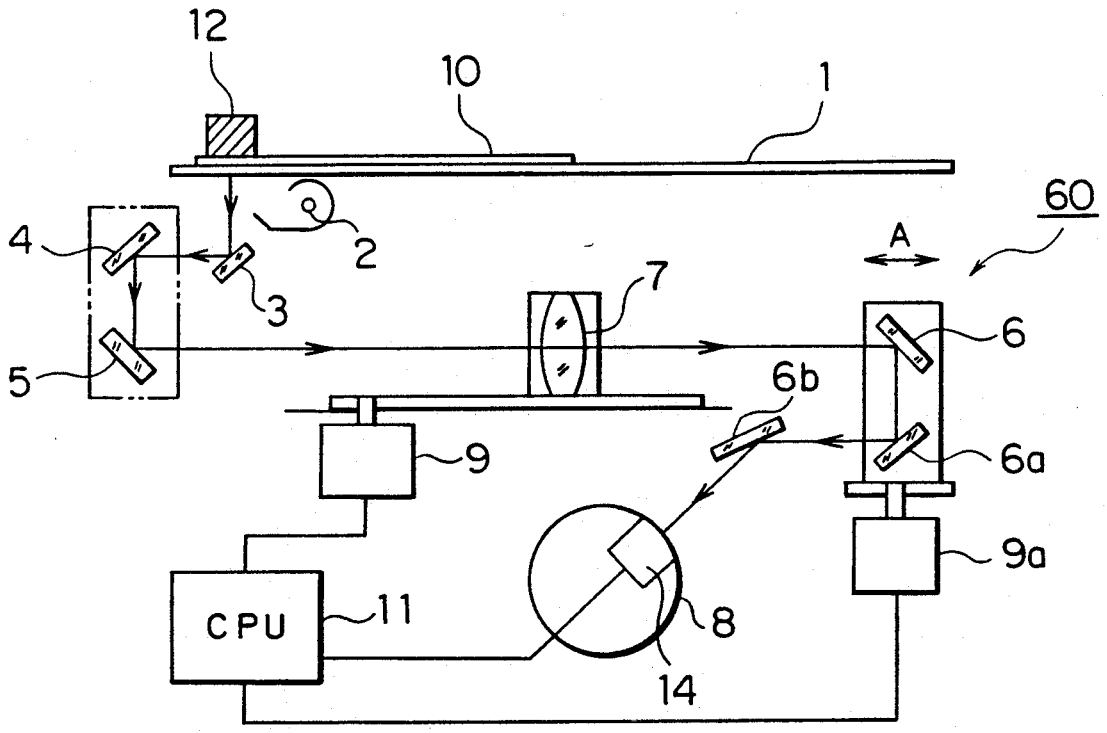
Figure 2:
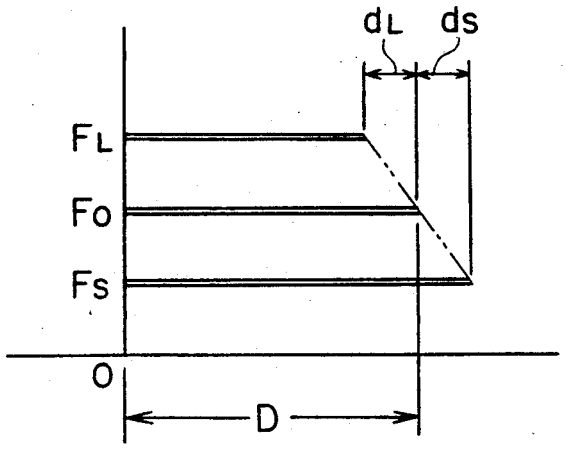
FIG. 2 is a graph showing the compensation of projection lens movement, wherein a focal length error is caused in the projection lens.

Referring to FIG. 1(*a*) and FIG. 1(*b*) which are schematic illustrations of a variable magnification optical zooming system, and FIG. 2 which is a graph showing the compensation of movement of a projection lens in which an error in the focal length is caused.

Like parts in each of the drawings are identified by the same reference character.

As described before, the focal length of the projection lens is varied within a range. Therefore, when movement of the standard focal length is applied to the movement of variation of magnification, the image magnification error is caused after the projection lens has been moved.

FIG. 2 is an illustration showing the concept of the compensation which is conducted in the case where the compensation is carried out with regard to standard focal length $F_O$ on the enlargement side, for example, wherein the life-size position is used as the origin. The movement of the projection lens, the focal length of which is standard focal length $F_O$, is represented by D on the horizontal length at the maximum magnification, for example, 2. In the case where the focal length is Fs which is shorter than $F_O$, movement D is shorter than the value needed for the image magnification of $F_O$, so that movement ds which is shown by the horizontal axis must be added to the aforementioned movement D in order to obtain the same image magnification. In the case of long focal distance $F_L$, movement $d_L$ must be deducted from the aforementioned movement D as shown in the drawing. In the manner described above, the actual image magnification becomes the same value as the magnification of the aforementioned $F_O$ which is the nominal set magnification.

The concept described above can be applied not only to the enlargement side but also to the reduction side so that magnification compensation can be conducted.

In the case of the present invention as illustrated in FIG. 1(*a*), in order to obtain the real focal length of the projection lens 7, the following operations are conducted.

(a) For example, the total optical length is set constant in the life-size position which is the home position, and the projection lens 7 is moved in the direction of arrow A by a stepping motor 9 so that the projection lens 7 can come to the position in which an image is formed in focus.

(b) The following is another method. The projection lens is fixed and the optical path length adjusting means 60 composed of the fourth mirror 6 and the fifth mirror 6a is moved in the direction of arrow A by the second stepping motor 9a so that the optical path length adjusting means 60 can come to the position where the image is in focus.

(c) The following is a further method. Both of the projection lens 7 and the aforementioned optical path length adjusting means are moved in the direction of arrow A so that the image can be in focus.

When the image is set in focus, for example, the actual image magnification m is measured using an adjusting tool of CCD or visual inspection. (Refer to FIGS. 1(*c*), 1(*d*), and 1(*e*).)

The adjusting method based on visual observation and method conducted by CCD will be explained as follows.

Adjusting Method (1) illustrated in FIG. 1(*c*) is as follows which is conducted based on visual observation: A focusing pattern (for example, a resolving power chart) is set on the photoreceptor drum 8 by a jig 12, and its image is projected on the surface of the platen glass 1 through the projection lens 7. Then, the projected image is visually observed through a magnifying lens 13 so that the state of image formation can be judged. The result of the visual observation is inputted into CPU 11, and the rotation of the first and second stepping motors 9, 9a is changed in order to change the movement of the projection lens 7 and the optical path length adjusting means 60 so that the focus can be adjusted accurately.

Adjusting Method (2) illustrated in FIG. 1(*d*) is as follows which is defined as Automatic Adjusting Method (1): A focusing pattern is set on the photoreceptor drum 8 by a jig 12, and its image is projected on the surface of the platen glass 1 through the projection lens 7. Then, the projected image is read by CCD 14 so that the state of image formation can be judged. The result of judgment is fed back to CPU 11 which controls the first and second stepping motors 9, 9a. The positions of the projection lens 7 and optical path length adjusting means 60 are changed by the stepping motors so that the focus can be accurately adjusted.

Adjusting Method (3) illustrated in FIG. 1(*e*) is as follows which is defined as Automatic Adjusting Method (2): The positions of the jigs 12 and 14 are replaced with each other in the aforementioned Adjusting Means (2).

Real focal length f of the aforementioned projection lens 7 is found by the following equations using the measured actual image magnification m and total optical path length U.

$$1/f = 1/a + 1/bm = b/a$$

$$U = (2 + m + 1/m)f + H + \delta m$$

where f: focal length of the projection lens m: magnification a: distance from the document image to the first principal point of the projection lens b: distance from the second principal point of the projection lens to the focal surface H: distance between the principal points of the projection lens δm: aberration of the projection lens U: total optical path length from the document surface to the focal surface.

Values of U, a, and b are found from the real focal length and an optional set magnification according to the above equations so that the compensation positions, in other words the movements, of the projection lens 7 and the optical path length adjusting means 60 can be determined. The aforementioned adjusting tool, which is shown in FIGS. 1(*c*), 1(*d*), and 1(*e*), is linked with CPU 11 provided inside the copier, and the aforementioned compensated movement is computed with regard to the aforementioned real focal distance of the projection lens 7 corresponding to the aforementioned fs and $F_L$, for example. Accordingly, when the real focal length, which has been found, is inputted through the ten-keys, the compensated life-size position and the movements of the projection lens 7 and the optical path length adjusting means 60 which have been compensated at each set magnification, are immediately computed and inputted into the aforementioned CPU 11. The movement caused by one pulse of the stepping motor is constant. Consequently, when the pulse controlled by the aforementioned CPU 11 is inputted, the first stepping motor 9 for driving the projection motor is driven so that the life-size position can be compensated and the home position can be determined. Then, the actual image magnification is made to agree with the nominal set magnification in such a manner that: a pulse is impressed according to the compensated movement by the aforementioned CPU 11 at each magnifying operation; the aforementioned projection lens 7, which is linked with the aforementioned first stepping motor 9 as illustrated in FIG. 1(*a*) is moved; and at the same time the second stepping motor 9a is driven which is used for adjusting the optical path length so that the fourth mirror 6 and the fifth mirror 6a which compose the optical path length adjusting means 60, can be integrally moved in parallel with the direction of lens movement.

Then, a document image of a predetermined magnification is formed on the photoreceptor drum 8 as follows. The document image 10 is illuminated with the light emitted from the light source 2 which is opposed to the platen glass 1; the illuminated light is projected by the first, second and third mirrors 3, 4, 5 and proceeds in the direction of an arrow; the light advances through the aforementioned fourth mirror 6 and fifth mirror 6a; and finally the light is projected and reflected on the surface of the sixth mirror 6b so that the document image can be formed on the photoreceptor drum 8 surface.

In the manner described above, an image can be obtained, the image magnification of which is the same as the nominal set magnification, and the resolution of which is very high. In the aforementioned example of the optical path length adjusting means, the actual image magnification which is the same as a predetermined nominal magnification, can be obtained by adjusting the optical path length according to the so-called rear-path system. On the other hand as illustrated in FIG. 1(*b*), it is possible to obtain an image of a predetermined image magnification by the so-called front-path system, in which the image is formed as follows: the fourth mirror 6 is fixed which is the final mirror to project light from the projection lens 7 to the photoreceptor drum 8; and the second mirror 4 and the third mirror 5 which compose the aforementioned second carriage are integrally moved in parallel with the projection lens moving direction by the second stepping motor 9b in accordance with the control of CPU 11 so that the optical path length can be adjusted at each magnification.

Consequently, in order to adjust the optical path length, it is possible to adopt either the rear-path system shown in FIG. 1(*a*) or the front-path system shown in FIG. 1(*b*).

When a focal length is found by measuring the actual magnification in the position where the image becomes in focus, it is sufficient to measure the actual magnification in only one optional magnification setting position. However, it is a good idea to measure the actual magnification in more positions in order to interpolate the compensation positions for the projection lens and the optical path length adjusting means.

Figure 3:
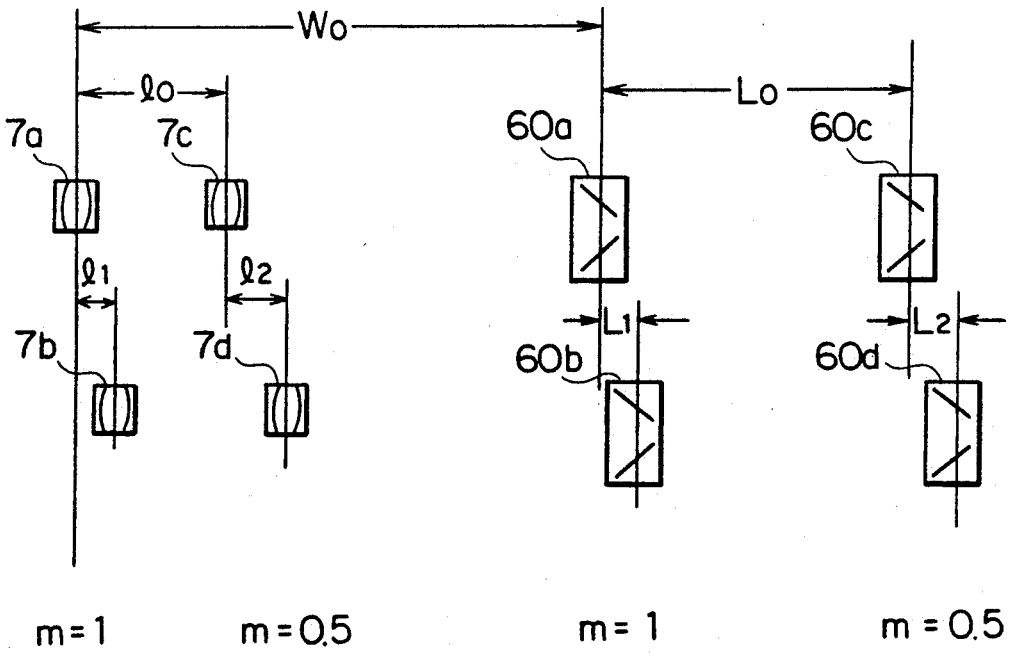
FIG. 3 is a schematic illustration showing the difference of movement between the projection lens and its standard value, and the difference of movement between the optical path length adjusting means and its standard value.
Figure 4:
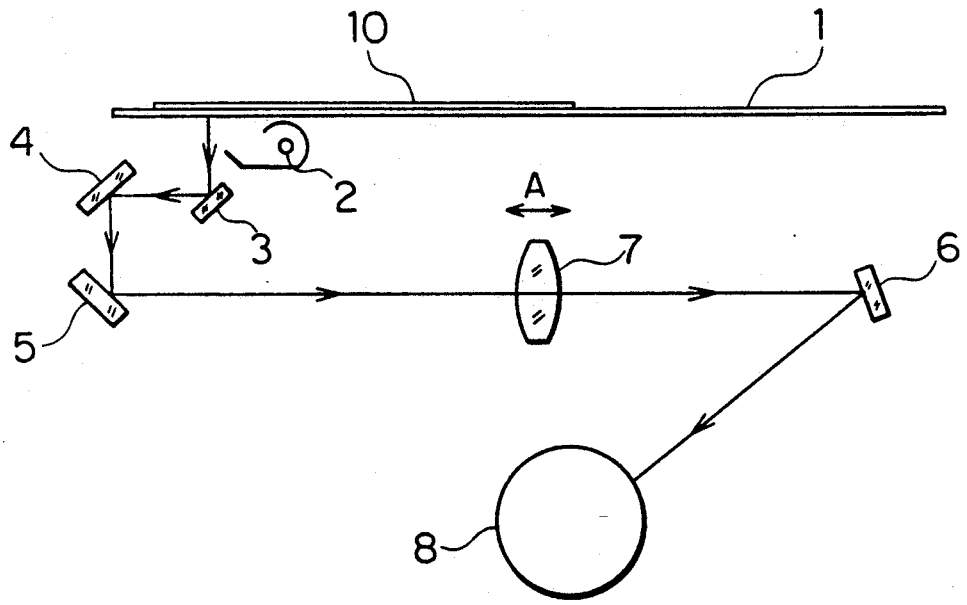
FIG. 4 is an illustration showing the principle of the variable magnification in zooming system.

Referring now to FIG. 1(*a*), FIG. 1(*b*) and FIG. 3, an embodiment of the present invention will be explained as follows, wherein FIG. 1(*a*) and FIG. 1(*b*) are schematic illustrations showing the composition of the variable magnification optical zooming system, and FIG. 3 is a schematic illustration showing the relational positions of the projection lens and the optical path length adjusting means at two magnifications.

As illustrated in FIG. 1(*a*), the projection lens 7 and the optical path length adjusting means 60 are moved in the direction A of an arrow at two magnifications, one is a life-size magnification and the other is the minimum magnification, so that the image in focus can be obtained. When the above-described operation has been completed, image magnification m is measured using an adjusting tool of CCD or visual inspection, and adjustment is conducted so that the measured magnification m can be the same as the set magnification.

As described before, the focal length of the projection lens is dispersed within a range, and further there are dimensional errors in the optical path length adjusting means, so that an error is caused in the image magnification when the projection lens and the optical path length adjusting means are moved in accordance with the standard values during variation of magnification. Therefore, while the magnification is measured, the projection lens 7 and the optical path length adjusting means 60 are moved in order to make the image magnification agree with a desired value so that the image can become in focus. FIG. 3 is a schematic illustration showing the relation of the difference between the actual movement and the standard movement of the projection lens and the optical path length adjusting means.

Numeral 7a is the position of the projection lens 7 at the magnification m=1, which has a standard focal length. Numeral 60a is the position of the optical path length adjusting means 60, the dimension of which is in the standard state, at the magnification m=1. In other words, a life-size image (m=1) is perfectly in focus in this position.

Numeral 7b is the position of the projection lens 7 having a slight error of the focal length at m=1 with regard to the standard value. Numeral 60b is the position of the optical path length adjusting means 60 when the image comes in focus at m=1, in the case where there is a manufacturing error in the optical path length adjusting means. In this case, the difference between 7a and 7b is expressed by $l_1$, and the difference between 60a and 60b is expressed by $L_1$. The distance between 7a and 60a is expressed by $W_O$.

Numerals 7c and 60c are the positions of the aforementioned projection lens 7 of the standard focal length and the optical path length adjusting means 60 of the standard dimension when the image is in focus at the minimum magnification of m=0.5.

Numerals 7d and 60d are the movement positions of the projection lens and the optical path length adjusting means when the image is in focus at the magnification of m=0.5, wherein there is an error in the focal length of the lens and there is a manufacturing error in the optical path length adjusting means.

In this case, the difference between the positions of 7c and 7d is expressed by $l_2$, the difference between the positions of 7a and 7c is expressed by $l_O$, the difference between the positions of 60c and 60d is expressed by $L_2$, and the difference between the positions of 60a and 60c is expressed by $L_O$.

In the manner described above, the difference $l_1$ between the position of the projection lens 7 and its standard position at the magnification of m=1, and the difference $L_1$ between the position of the optical path length adjusting means 60 and its standard position at the magnification m=1, are measured. In the same way, the difference $l_2$ between the position of the projection lens 7 and its standard position at the magnification of m=0.5, and the difference Lo between the position of the optical path length adjusting means 60 and its standard position at the magnification m=0.5, are measured. Therefore, when the magnification m is between 0.5 and 1, the difference between the projection lens and its standard position, and the difference between the optical path length adjusting means and its standard position, are found by proportional distribution based on the above-described values so that compensation can be conducted. When the setting positions of the projection lens 7 and the optical path length adjusting means 60 are determined in the manner described above, accurate magnification and focusing can be easily achieved.

The above-described standard positions are computed by the following equations which have been explained before.

$$1/f=1/a+1/bm=b/a$$

$$U=(2+m+1/m)f+H+\delta m$$

Based on magnification m and standard focal length f, values a and b with regard to magnification m are computed so that a table can be made. Compensated values A and B of a and b with regard to magnification m, can be found according to the computed values of $l_1$, $L_1$, $l_2$, $L_2$, $l_O$, $L_O$ and $W_O$. In the manner described above, a table on which the positions of the projection lens 7 and the optical path length adjusting means 60 at each magnification are properly displayed can be made.

Specifically, a correct compensation can be positively realized when the projection lens is moved by the first stepping motor 9 and the optical path length adjusting means 60 is moved by the second stepping motor 9a in accordance with the pulse conversion value of the compensated value at each magnification as illustrated in FIG. 1(*a*).

The above-described stepping motors 9 and 9a are linked by CPU 11. Based on the movements of the lens 7 and the optical path length adjusting means 60 at two magnification values, the interpolating compensation value is immediately computed and its pulse is transmitted to each stepping motor so that the motor can be individually driven.

As described above, in the rear-path system, the position compensation is conducted utilizing the optical path length adjusting means 60. In the same manner as the aforementioned rear-path system, the front-path system can be used in which the optical path length adjusting means composed of the mirrors 4, 5, instead of the means 60, is driven by the stepping motors 9*b* as shown in FIG. 1(*b*), and the projection lens 7 is also driven by the stepping motor 7 so that setting can be conducted.

In the embodiment described above, the life-size and the minimum magnification are selected as the two magnifications. However, the present invention is not limited to the above-described magnifications. The life-size and the maximum magnification may be selected, or any optional two magnifications may be selected.

The present invention can provide the following effects. Even when there are dimensional errors in the focal length of the projection lens and in the installation of the mirrors of the optical path length adjusting means, the optical system can be easily assembled and adjusted, and an image of high resolution, the actual magnification of which is the same as the nominal magnification, can be obtained during variation of magnification.

What is claimed is:

1. A method for compensating variable image magnification in a zooming system, in which a magnified image is formed on a focal surface by projecting a document image through a projection lens and onto mirrors provided to a variable optical path length means, comprising the steps of:

(a) selecting an optional nominal magnification within a predetermined magnification range;

(b) moving at least one of the projection lens and the variable optical path length means so as to be in focus;

(c) measuring an actual image magnification at a position where the projection lens is in focus;

(d) calculating an actual focal length of the projection lens through the following equations, based on the measured actual image magnification, $$1/f=1/a+1/b, m=b/a$$

$$U\ 32\ (2+m+1/m)f+H+\delta m$$

in which f represents the focal length of the projection lens, m represents the magnification, a represents the distance between the document image and the first principal point of the projection lens, b represents the distance between the second principal point of the projection lens and the focal surface, H represents the distance between the first and the second principal points, δm represents the aberration of the projection lens and U represents the entire optical path length between the document image surface and the focal surface;

(e) determining compensation positions of the projection lens and the variable optical path length means, based on the calculated focal length and the selected optional nominal magnification; and (f) moving the projection lens and the variable optical path length means to the determined compensation positions.

2. The method of claim 1, wherein a memory means is provided for storing data with respect to compensation positions of the projection lens and the variable optical path length means.

3. The method of claim 1, wherein two stepping motors are provided for independently moving the projection lens and the variable optical path length means.

4. A method for compensating variable image magnification in a zooming system, in which a magnified image is formed on a focal surface by projecting a document image through a projection lens and onto mirrors provided to a variable optical path length means, comprising the steps of:

(a) selecting two optional nominal magnifications within a predetermined magnification range;

(b) moving the projection lens and the variable optical path length means so as to be in focus in response to both selected optional nominal magnifications;

(c) calculating a standard position of the projection lens having a designed focal length and a standard position of the variable optical path length means having a designed optical path length through the following equations, $$1/f=1/a+1/b, m=b/a \text{ and}$$

$$U=(2+m+1/m)f+H+\delta m$$

in which f represents the focal length of the projection lens, m represents the magnification, a represents the distance between the document image and the first principal point of the projection lens, b represents the distance between the second principal point of the projection lens and the focal surface, H represents the distance between the first and the second principal points, δm represents the aberration of the projection lens and U represents the entire optical path length between the document image surface and the focal surface;

(d) measuring differences between each of the in-focus positions and each of the standard positions of the projection lens, and between each of the in-focus positions and each of the standard positions of the variable optical path length means;

(e) determining compensation positions of the projection lens and the vatiable optical path length means, based on the measured results; and (f) moving the projection lens and the variable optical path length means to the compensated positions.

5. The method of claim 4, wherein two stepping motors are provided for independently moving the projection lens and the variable optical path length means.

* * * * *

UNITED STATES PATENT AND TRADEMARK OFFICE

CERTIFICATE OF CORRECTION

PATENT NO. : 5,117,256

DATED : May 26, 1992

INVENTOR(S) : Fumio Haibara

It is certified that error appears in the above-identified patent and that said Letters Patent is hereby corrected as shown below:

Claim 1, column 9, line 45, in the greater equation, change "32" to --=--.

Claim 4, column 10, line 59, change "vatiable" to --variable--.

Signed and Sealed this

Twenty-eighth Day of September, 1993

Bruce Lehman

*Attest:*

BRUCE LEHMAN

*Attesting Officer*

*Commissioner of Patents and Trademarks*